US006758330B1

(12) United States Patent
Chudada

(10) Patent No.: US 6,758,330 B1
(45) Date of Patent: Jul. 6, 2004

(54) JEWELRY DISPLAY DEVICE

(75) Inventor: John Chudada, Akron, OH (US)

(73) Assignee: Sterling Jewelers Inc., Akron, OH (US)

( * ) Notice: Subject to any disclaimer, the term of this patent is extended or adjusted under 35 U.S.C. 154(b) by 0 days.

(21) Appl. No.: 10/307,542

(22) Filed: Dec. 2, 2002

(51) Int. Cl.[7] ..... A45C 11/04
(52) U.S. Cl. ..... 206/6.1; 206/45.23; 206/459.5
(58) Field of Search ..... 206/6.1, 45.2, 206/45.23, 45.24, 566, 776, 777, 459.5; D6/396, 444, 466, 467, 475, 476; D14/447

(56) References Cited

U.S. PATENT DOCUMENTS 1,960,073 A * 5/1934 Warner ..... 206/6.1
2,317,203 A * 4/1943 Kurhan ..... 206/45.2
2,813,622 A * 11/1957 Lancellotti ..... 206/6.1
3,718,260 A * 2/1973 Sharp ..... 206/6.1
3,769,741 A * 11/1973 Hessler et al. ..... 206/6.1
3,937,319 A * 2/1976 Roy ..... 206/6.1
4,371,077 A * 2/1983 Solitt et al. ..... 206/6.1
4,732,269 A * 3/1988 Roy ..... 206/45.13
4,930,628 A * 6/1990 Bridges ..... 206/45.23
5,007,530 A * 4/1991 Weismantel ..... 206/45.2
5,435,437 A * 7/1995 Sasaki ..... 206/45.23
5,927,487 A * 7/1999 Whittle et al. ..... 206/45.2
5,927,493 A * 7/1999 Colombo ..... 206/372
6,450,328 B1 * 9/2002 Machacek et al. ..... 206/63.5
6,471,077 B1 * 10/2002 Johnson ..... 211/85.2

* cited by examiner

*Primary Examiner*—Shian Luong
(74) *Attorney, Agent, or Firm*—Renner, Kenner, Greive, Bobak, Taylor & Weber

(57) ABSTRACT

A jewelry display device, including a base having a top and bottom surface, a cover having one end hingedly attached to one end of the base, the base having at least a first display member on the top surface thereof, and the cover being selectively movable between a position overlying the top surface of the base and a position underlying the bottom surface of the base.

12 Claims, 3 Drawing Sheets

JEWELRY DISPLAY DEVICE

RELATED PATENT APPLICATIONS

None.

FIELD OF THE INVENTION

In general, the present invention relates to jewelry display devices. More particularly, the present invention relates to a jewelry display device having a first position for displaying jewelry located thereon and a second position for protecting and storing the jewelry in a covered state. Most particularly, the present invention relates to a jewelry display device having a foldable cover that may be folded under a base to prop up jewelry, located on the base, for display and folded over top of the base to cover the jewelry, for handling, protection and storage.

BACKGROUND OF THE INVENTION

Jewelry retailers implement different methods of display jewelry within jewelry cases including display members such as partial torsos, boards on which the jewelry is laying, and trays that receive jewelry. Often, to better position the jewelry for display, these members are elevated or placed at an angle relative to the floor of the display case. While these devices are effective in displaying the jewelry, often they are not suitable for immediate storage or transport, and, thus, the jewelry must be removed from these devices and placed in storage drawers or other receptacles. Therefore, it is desirable to have a jewelry display device capable of having a first position for display of the jewelry and a second position for the handling, protection and storage of the jewelry.

SUMMARY OF THE INVENTION

It is an object of the present invention to provide a jewelry display device having a first position for display of the jewelry and a second position for the handling, protection and storage thereof.

In view of the foregoing object, a jewelry display device according to the concepts of the present invention, generally includes a base having a top and a bottom surface, a cover having one end hingedly attached to one end of the base, the base having at least a first display member on the top surface thereof, and the cover being selectively moveable between a position over lying the top surface of the base and a position underlying the bottom surface of the base.

BRIEF DESCRIPTION OF THE PREFERRED EMBODIMENTS

Figure 1:
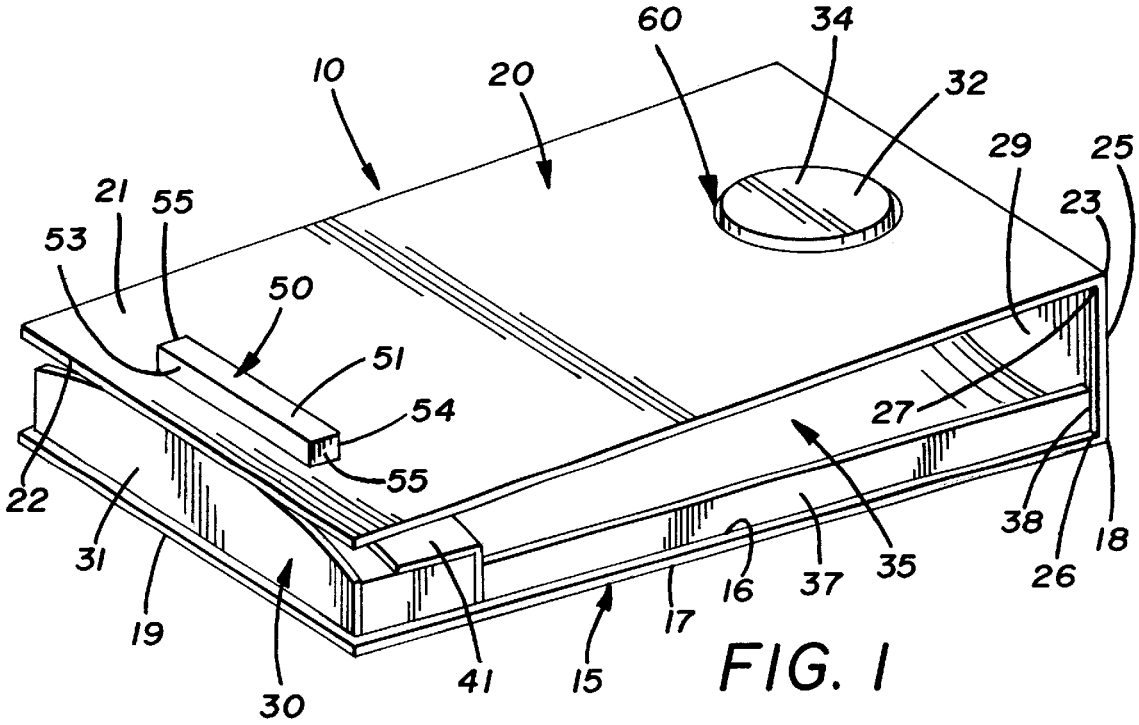
FIG. 1 is a perspective view of a jewelry case according to the concepts of the present invention depicted in a first or covered position used for transport or storage of jewelry.

One example of a jewelry display device according to the concepts shown in the accompanying drawings and generally indicated by the numeral 10. Jewelry display device 10 generally includes a base 15 having a top surface 16 and a bottom surface 17, and a cover 20 having a first surface 21 and a second surface 22. The cover 20 is hingedly attached to an inboard end 18 of base 15, as by a connecting member 25 having a first edge 26 attached to the base 15 at the inboard end 18 and a second edge 27 attached to the cover 20 at an inboard end 23 thereof. As will appreciated, the base 15, cover 20, and connecting member 25 may be of unitary construction, such that a continuous assembly is formed. In the example shown, the base 15 and cover 20 are of substantially the same length. The cover 20 may be of somewhat greater length to ensure that the base 15 is covered, when the display device 10 is in a first or covered condition, depicted in FIG. 1. It will be appreciated, however, that it may be desirable to leave a portion of the base exposed and, thus, the cover 20 may be shortened or otherwise modified for that purpose.

A stop generally indicated by the numeral 30 may be provided to space the outboard ends 19, 24 respectively of the base 15 and cover 20 in the vertical sense. As shown, stop 30 may be in the form of an upstanding member 31 interposed between the outboard ends 19, 24. The member 31 may be attached to either of the cover 20 or base 15, and in contrast to the member 31 shown in the accompanying drawings, need not cover the entire width W of the display device 10. As will further be appreciated, the stop 30 may be interposed between the base 15 and cover 20 at any location along the length L of the display device 10. For example, a surface 32 of a first display member, generally indicated by the numeral 35 and described more completely below, supported on the base 15 may contact the second surface 22 of the cover 20 to act as a stop. Or, when a portion of the first display member protrudes through the cover 20, a shoulder 33 formed on the first display member 35 may act as a stop by contacting the second surface 22 of the cover 20.

Figure 2:
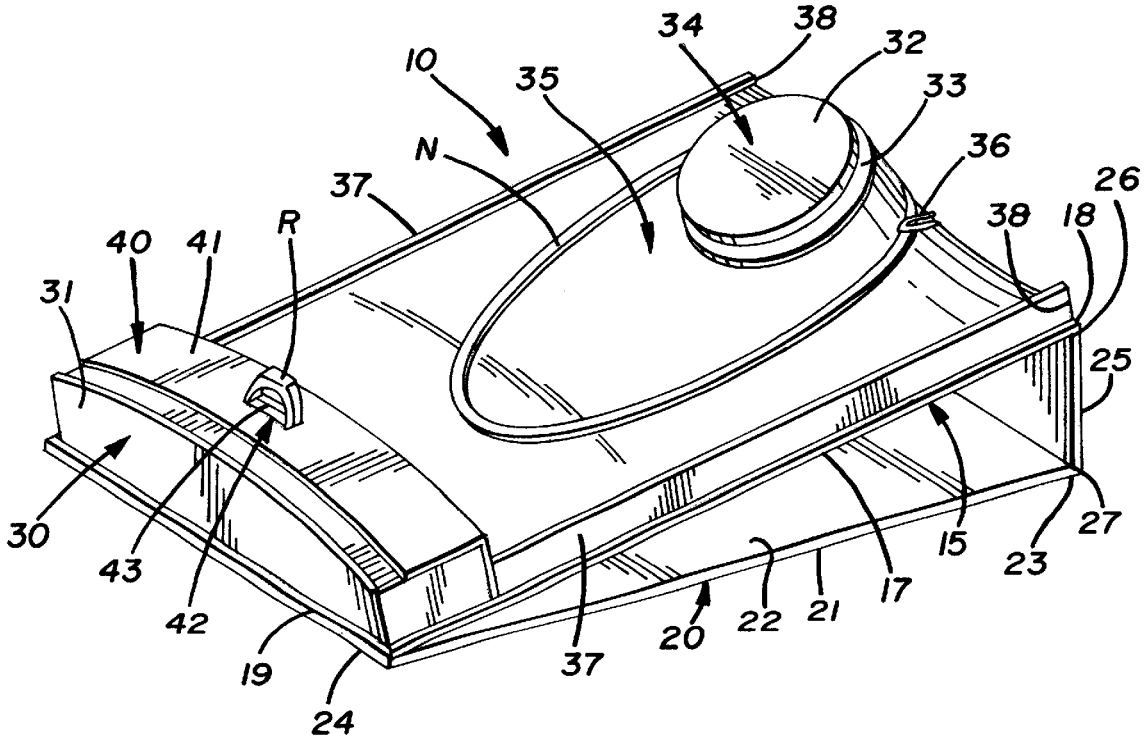
FIG. 2 is perspective view similar to FIG. 1 depicted in a second position where the cover has been folded under the case of the jewelry display device placing the display device in a second position suitable for displaying the jewelry.

As depicted in the Figures, the base 15 may support any number of display devices, such as first display device 35, which as shown in FIG. 2, for example, in the form of a partial torso used to display necklaces or chains. Suitable clips 36 or similar securement members may be provided to hold the necklace N in a selected position on the first display member 35. The highest point of first display device 35 may be provided with a cap member 34, to which, as shown, indicia may be applied for advertising or identification purposes. First display member 35 may further include upstanding walls 37 supported on base 15 having inboard ends 38 that may contact the interior surface 29 of the connecting member 25 to act to limit the range of motion of the connecting member 25.

One or more secondary display members, generally indicated by the numeral 40 may also be supported on the base 15. In the example shown, the secondary display member 40 is in the form of a pad 41 provided with one or more receivers, generally indicated by the numeral 42 for the receipt of various jewelry items. For example, receiver 42 may be in the form of a padded slot 43 adapted to hold a matching ring R or bracelet for display.

Figure 3:
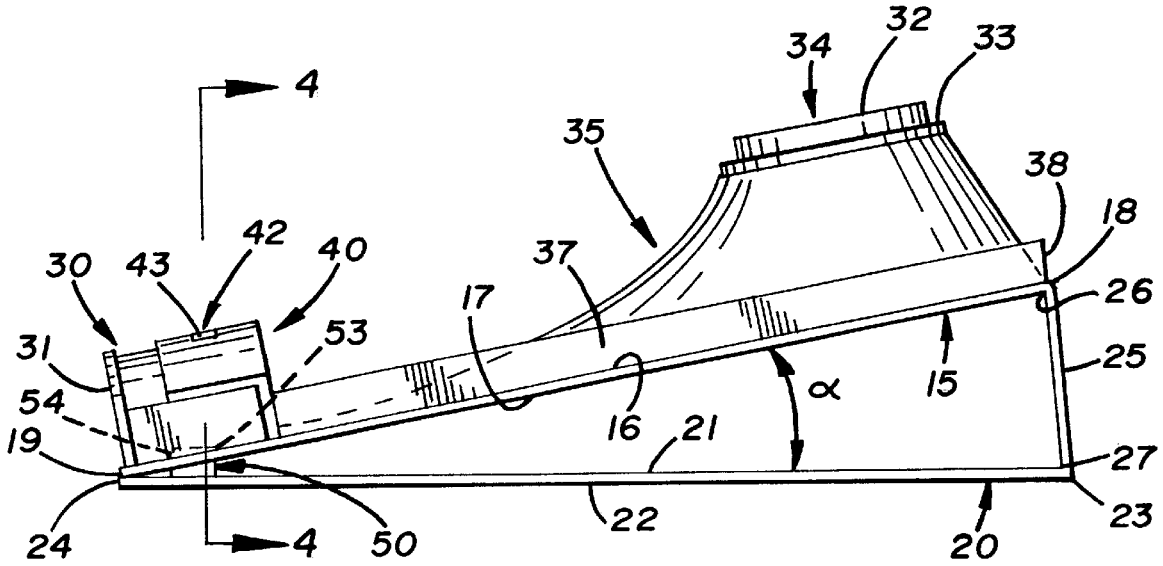
FIG. 3 is a side elevational view of the jewelry display device shown in FIG. 2.
Figure 4:
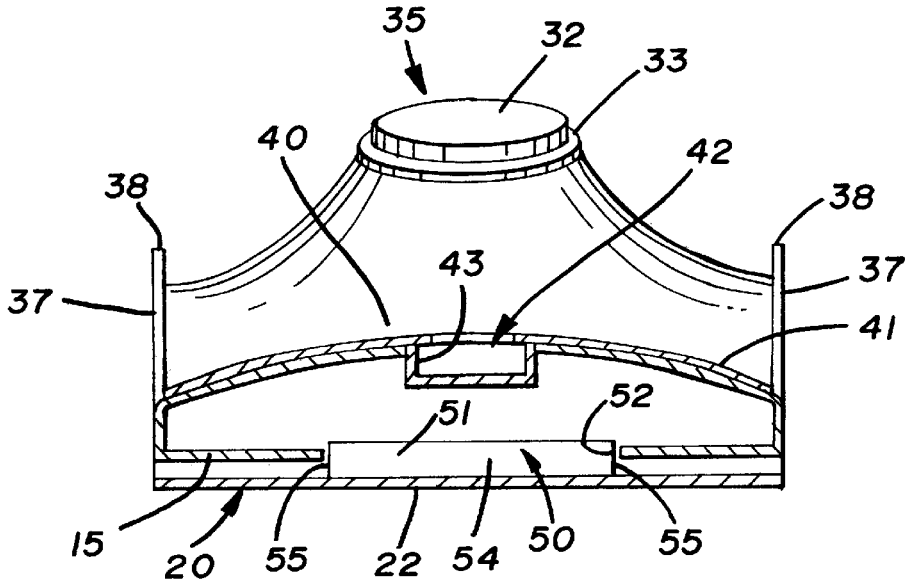
FIG. 4 is a sectional front elevational view taken along the line 4—4 in FIG. 3.
Figure 5:
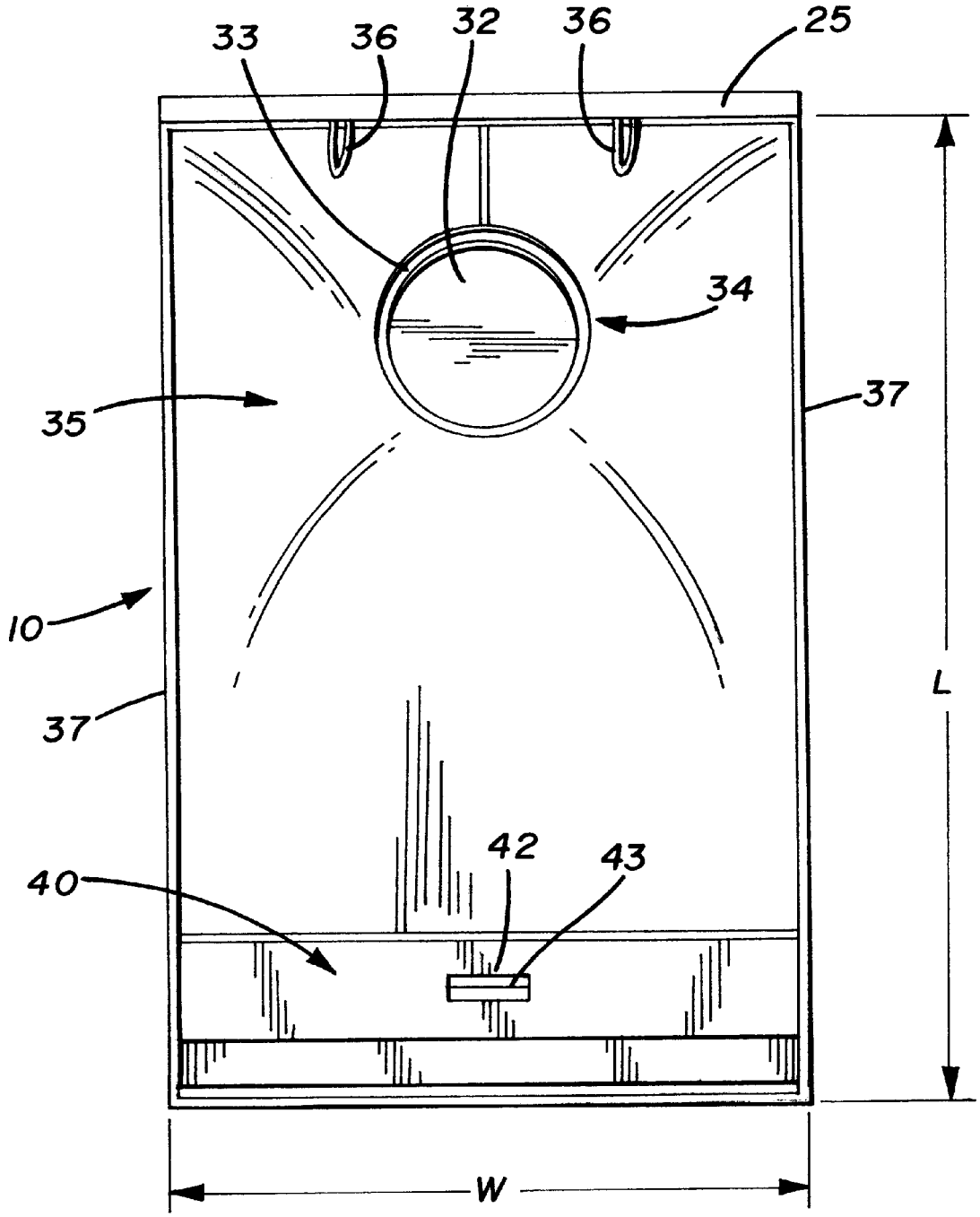
FIG. 5 is a top plan view of the jewelry display device depicted in FIG. 3.

It is often desirable to present the display members 35, 40 at an angle. When this is done, the article, such as a necklace, will form a natural drape simulating its appearance when actually worn by the purchaser. To that end, cover 20 may be hinged, such that it can underlie the base 15 acting as a prop to incline the base 15 at an angle $\alpha$. For example, in the embodiment depicted in the drawings, the cross member 25 acts as a prop to incline the base 15 at the angle $\alpha$. As best shown in FIG. 3, the cover 20 is folded back upon the base 15 such that the cover 20 underlies the base 15 having its first surface 21 facing the bottom surface 17 of the base 15. As shown in FIG. 3, the surfaces 17, 21 may contact each other at the outboard ends 19, 24 of the base 15 and cover 20. In the position depicted in FIG. 2 of the connecting member 25 are inverted such that the second end 27 that attaches to the cover 20 underlies the base 15. The length of the connecting member 25 may be used to control the degree of inclination of the base 15. For example, for a steeper angle a than that shown in FIG. 3, the connecting member 25 may be lengthened. Conversely, a shorter connecting member 25 may be used to form a smaller anlge $\alpha$.

To couple the base 15 and cover 20 such that they do not slide relative to each other, a condition, which might cause the connecting member 25 to become unstable causing the base 15 to fall, a coupler, generally indicated by the numeral 50 may be provided. Coupler 50 may be any device capable of preventing relative movement of the base 15 and cover 20. As would be apparent to one of ordinary skill in the art, fasteners, such as Velcro®, clips, snaps or similar devices would be suitable for this purpose. In the example depicted in the Figures, coupler 50 includes a coupling member 51 that projects from the first surface 21 of the cover 20 and is received within a recess or slot 52 defined in the base 15. The outboard surface 53 and inboard surface 54, as shown in FIG. 1, act as positive stops to any lengthwise sliding of the base 15 or cover 20 relative to each other. The ends 55 of the member 51 also would act to stop any widthwise movement of the base 15 and cover 20 relative to each other. Conveniently, member 51 may be used as a handle to lift the cover 20, when in the covered condition, shown in FIG. 1.

Since advertising, branding information, or other indicia may be placed on surface 32 of first display member 35, it may be desirable to provide an opening, generally indicated by the numeral 60, in the cover 20 to allow viewing of the surface 32 on either of the covered (FIG. 1) or open (FIG. 2) positions of display device 10. As shown in FIG. 1, surface 32 may protrude outward beyond the plane of the first surface 21 when the cover rests on shoulder 33. As will be appreciated, similar openings may be formed to allow viewing of various underlying portions of the first display member 35 or any secondary display members 40. The protrusion of the cap 34 through the opening 60 restricts movement of the cover 20 when in the closed position.

When using the jewelry display device 10, the user could place one or more display members 35, 40 on the base 15, attach jewelry, for example, necklaces N and or rings R, and fold the cover 20 back and underneath the base 15 to place the device 10 in an inclined viewing condition, shown in FIG. 2. When the jewelry display device 10 is to be stored or transported, the display device 10 may be returned to a covered condition, FIG. 1, where the cover 20 is folded over the base 15 and rests upon the base 15, the display members 35, 40 or a stop 30. In this condition, the jewelry N, R and display members 35, 40 underlie the cover 15 and are protected from light, dust, and debris that might ordinarily fall upon them. Further, the display device 10 facilitates transport of the jewelry without the user having to hold the display member 35, 40 avoiding inadvertent contact with the jewelry that might cause oil from the user's skin to mark the jewelry.

While a full and complete description of the invention has been set forth in accordance with the dictates of the patent statutes, it should be understood that modifications can be resorted to without departing from the spirit hereof or the scope of the appended claims.

What is claimed is:

1. A jewelry display device, comprising:

a) a base having a top and bottom surface, said base having at least a first display member on said top surface thereof;

b) a cover having one end hingedly attached to one end of said base, said cover being selectively movable between a position overlying said top surface of said base and a position underlying said bottom surface of said base;

c) a coupler projecting from a top surface of said cover and d) a recess in said bottom surface of said base, said cover and said base being selectively coupled by the receipt of said coupler in said recess when said cover is in said position underlying said bottom surface of said base.

2. The display device of claim 1 further characterized by the presence of a connecting member having first and second edges; said first edge being hingedly connected to said one end of said cover; and said second edge being hingedly attached to said one end of said base.

3. The display device of claim 1, wherein said at least a first display member is contoured to simulate at least a portion of the upper torso of an individual.

4. The display device of claim 1 further characterized by the presence of a second display member disposed on and projecting upwardly from said top surface of said base.

5. The display device of claim 4, wherein said second display member is disposed adjacent the end of said base opposite said one end thereof.

6. The display device of claim 1, wherein said cover defines an opening.

7. The display device of claim 6, wherein said opening is aligned with a selected portion of said at least a first display member.

8. The display device of claim 7, wherein said opening receives a portion of said at least a first display member therethrough when said cover is in said position overlying said top surface of said base.

9. The display device of claim 8, wherein said portion of said at least a first display member extending through said opening has a surface displaying indicia.

10. The display device of claim 1, further comprising a stop interposed between said top surface of said base and a second surface of said cover to provide a selected spacing between said cover and said base when said cover is in said position overlying said top surface of said base.

11. The display device of claim 1, wherein said base is disposed at a display angle when said cover is in said position underlying said bottom surface of said base.

12. A jewelry display device, comprising:

a) base having a top and bottom surface, said base having a first and second display members on said top surface, wherein said first display member is contoured to simulate at least a portion of the upper torso of an individual and said second display member is a ring receiver;

b) a necklace displayed on said first display member, about the simulated upper torso thereof;

c) a ring displayed in said ring receiver; and b) a cover hingedly attached to one end of said base and being selectively movable about this hinged attachment between a storage position overlying said top surface of said base, to cover and protect said necklace and said ring, and a display position underlying said bottom surface of said base, to uncover and display said necklace and said ring at a display angle, wherein said cover includes an opening that, in said storage position, receives a portion of said first display member therethrough, said first display member including indicia on said portion received through said opening, said indicia serving to identify information regarding said ring or said necklace or both.

* * * * *